United States Patent [19]

Hill

[11] Patent Number: 4,890,086

[45] Date of Patent: Dec. 26, 1989

[54] TRANSFORMER ASSEMBLY

[75] Inventor: Norris L. Hill, New Bloomfield, Mo.

[73] Assignee: Westinghouse Electric Corp., Pittsburgh, Pa.

[21] Appl. No.: 347,301

[22] Filed: May 4, 1989

[51] Int. Cl.[4] ..... H01F 27/26; H01F 41/00

[52] U.S. Cl. ..... 336/210; 29/606; 336/92

[58] Field of Search ..... 336/92, 210, 197, 98; 310/217, 218; 29/602.1, 606, 607, 609

[56] References Cited

U.S. PATENT DOCUMENTS

| | | | |
|---|---|---|---|
| 1,242,815 | 10/1917 | Kohler | 52/826 |
| 1,672,419 | 6/1926 | Lehman | 403/101 |
| 1,771,297 | 7/1930 | Howes | 336/210 |
| 2,294,322 | 8/1942 | van Der Woude | 336/210 |
| 2,494,350 | 1/1950 | Mittemaier | 336/210 |
| 2,958,060 | 10/1960 | Kalb | 336/210 |
| 3,156,885 | 11/1964 | Koza | 336/197 |
| 3,210,708 | 10/1965 | Franklin et al. | 336/217 |
| 3,760,316 | 9/1973 | Czewski et al. | 336/210 |
| 4,260,975 | 4/1981 | Wilcox et al. | 336/210 X |
| 4,353,052 | 10/1982 | Geschka | 336/210 |
| 4,518,942 | 5/1985 | Geschka | 336/210 |

*Primary Examiner*—Thomas J. Kozma
*Attorney, Agent, or Firm*—B. R. Studebaker

[57] ABSTRACT

Coil-core assembly for a transformer including a plurality of coils and cores supported in a U-frame. The frame includes a cross member from whose ends legs extend. The cross member and the legs are channels. Near the corners of the frame the flanges of the channels are separated so that the legs are, in effect, hinged about the material remaining at the corners. Before the coils and cores are inserted in the frame, the legs are set at an angle of between 91° and 93° to the cross member so that the coils and cores may be readily positioned in the frame. On each side of each gap, spanning the gap, axially coextensive lugs are welded to the flanges. The coils and cores are disposed on the cross member between the legs. Each pair of lugs spanning a gap is penetrated by a bolt on which a swage nut is threaded and torqued so that the lugs and the boundaries of the gap are drawn towards each other, the legs are positioned substantially perpendicular to the cross member and the coils and cores are held firmly between the legs.

12 Claims, 5 Drawing Sheets

TRANSFORMER ASSEMBLY

BACKGROUND OF THE INVENTION

This invention relates to the transformer art and it has particular relationship to power transformers and the mounting of the coils and cores of power transformers, i.e., to their coil-core assemblies. The standard American National Standards Institute ratings of the transformers with which this invention primarily concerns itself in kilo-volt-amperes are 75, 112.5, 150, 225, 300, 500, 750, 1000, 1500, 2000 and 2500. There are also non-standard ratings of 30 and 45 KVA. While this application emphasizes power transformers in the interest of dealing concretely with this invention, it is to be understood that, to the extent that the principles of this invention may be adapted to transformers of other types, such adaptation is within the scope of equivalents thereof, typically as scope of equivalents is defined and explained in the interpretation of the Doctrine of Equivalents in Uniroyal v. Rudkin-Wiley, 5 USPQ 2d 1434 (CAFC 1988)(at 1443).

A coil-core assembly includes coil means, typically a plurality of coils each including a primary and a secondary and core means, typically rectangular cores each in the shape of a window linked to each coil. The assembly also includes a U-frame in which the coils and cores are mounted. The U-frame is composed of a cross member from whose ends legs extend. The coils and cores are mounted on the cross member of the frame and engaged firmly by the legs. In constructing the coil-core assembly, it is necessary to position the coils and cores within the U-frame and this involves manipulating the legs so that the coils and cores may be positioned within the frame. Since the U-frame is typically composed of channels of substantial thickness, typically steel 0.25-inch thick, or greater, the assembly of coils and cores in the frame presents serious obstacles and, in accordance with the teachings of the prior art, requires clamping and jacking devices.

Another factor requiring consideration is a consequence of the high power which the coil-core assembly converts. On the occurrence of an overload, such as a short circuit, within the coil-core assembly, large forces are developed which tend to blow the assembly apart. It is necessary that these forces be contained and for this purpose it has been the practice of the prior art to provide the frame with braces enhancing the complexity and cost of construction and the cost of the coil-core assembly itself.

In particular the braces are necessary where the U-frame is formed from a blank in which V notches are stamped in the regions where the legs are to be bent at right angles to the cross member. After the bending operation, there are slits at the joints between the legs and the cross member. In the event of an overload, the legs could be pivoted outwardly at the joints. In accordance with the teachings of the prior art, the legs are braced by heavy braces against the tank in which a prior-art coil-core assembly is installed.

It is an object of this invention to overcome the drawbacks and the deficiencies of the prior art, and to provide a coil-core assembly for a transformer lending itself to ready construction without clamping and jacking devices and which, when constructed, shall be effectively resistant to the forces produced by overloads such as short circuits. It is also an object of this invention to provide a method for producing such a coil-core assembly.

SUMMARY OF THE INVENTION

The coil-core assembly according to this invention includes a U-frame composed of a cross member from whose ends legs extend. The cross member and the legs are channels. A channel has a web from whose long ends flanges extend perpendicularly to the web. The U-frame is formed with the legs prespaced from the cross member at the corners of the frame. This is effected by opening the V-notches at the junctions between the legs and the cross member usually during the fabrication of the frame. It is within the scope of this invention to prespace only one leg from the cross member at the corners of this leg and the cross member, i.e., to open up the V-notches only in the junctions between one leg and the cross member. Lugs are secured or joined to the flanges of the channels spanning the prespaced gap. The legs are flexed outwardly at the prespaced opened gap so that they are at an angle greater than 90° by a small magnitude between 1° and 3° to the cross member, i.e., the plane of the web of each leg is at 91° to 93° to the plane of the web of the cross member. The pair of lugs at each corner is penetrated by a bolt. The inside diameter of each lug is dimensioned slightly larger than the diameter of the bolt to allow for slight angular misalignment. The coils and the cores are inserted in the frame resting on the ends of the flanges of the cross member. Since the legs are deflected outwardly, the coils and the cores are readily positioned on the cross member without the aid of clamping and jacking devices. A swage nut is then threaded on the threaded end of each bolt and torqued to draw the lugs and each leg and cross member together. Each leg is thus deflected to perpendicularity with the cross member. In the perpendicular position, the legs engage the ends of the coils and cores firmly. The forces produced by overloads and the expansive forces produced by reason of overheating of the coils are effectively resisted.

BRIEF DESCRIPTION OF THE DRAWINGS

For a better understanding of this invention, both as to its organization and as to its method of operation, together with additional objects and advantages thereof, reference is made to the following description taken in connection with accompanying drawings, in which:

FIGS. 6 through 10 show dimensions for a typical U-frame. These dimensions are shown not with any intention of in any way limiting this invention, but for the purpose of aiding those skilled in the art in the understanding of this invention.

DETAILED DESCRIPTION OF EMBODIMENT

Figure 4:
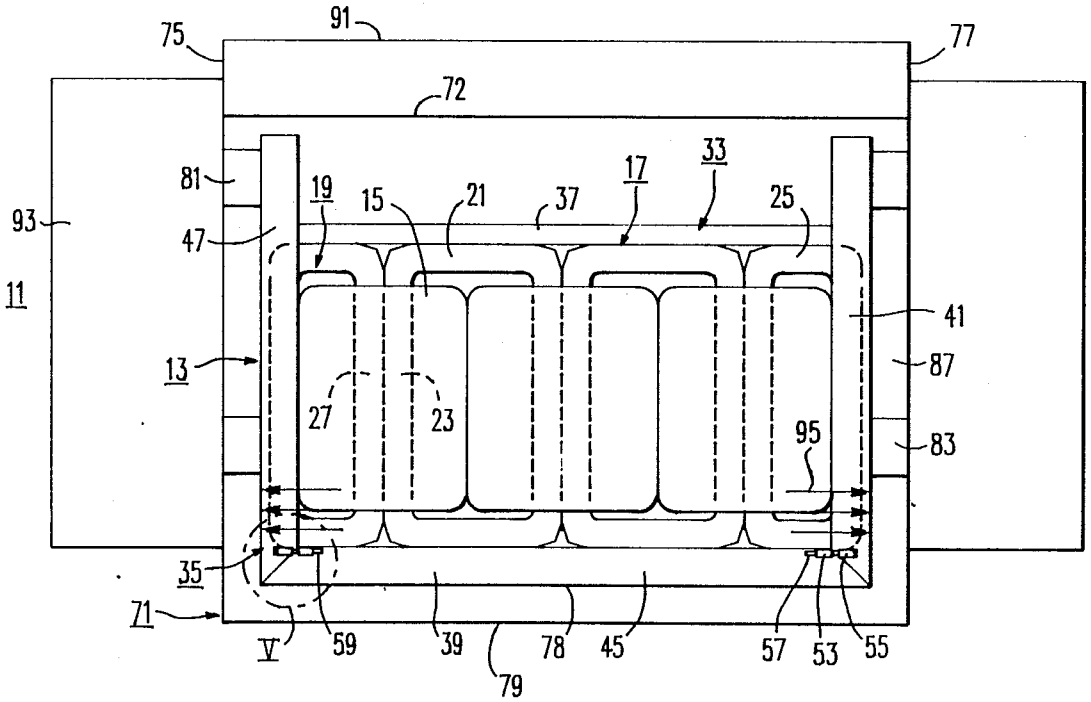
FIG. 4 is a diagrammatic view showing in longitudinal section the inside of a transformer having a coil-core assembly in accordance with this invention.

The apparatus shown in the drawings includes a three-phase distribution transformer 11 (FIG. 4) having a coil-core assembly 13 in accordance with this invention. The transformer 11 is of conventional construction and includes a plurality of coils 15, intermediate cores 17 and end cores 19. The cores 17 and 19 are of rectangular shape defining windows. Each intermediate core 17 has yokes 21 which extend over about half of an end coil 15 and an intermediate coil and legs 23 (FIG. 4) which extend through the coils on each side. The legs 21 of the intermediate core are in abutment in the center coil 15. Each end core 19 has yokes 25 which pass over the remaining half of the associated end coil and legs 27, one of which passes through the associated end coil in abutment with a leg 21 of the adjacent intermediate window. Each coil 15 has terminals 29 and 31.

The support 33 for the coil 15 and cores 17 and 19 include a U-frame 35 and a top frame 37. The U-frame 35 includes a cross member 39 and legs 41. The cross member 39 and legs 41 are channels.

Figure 6:
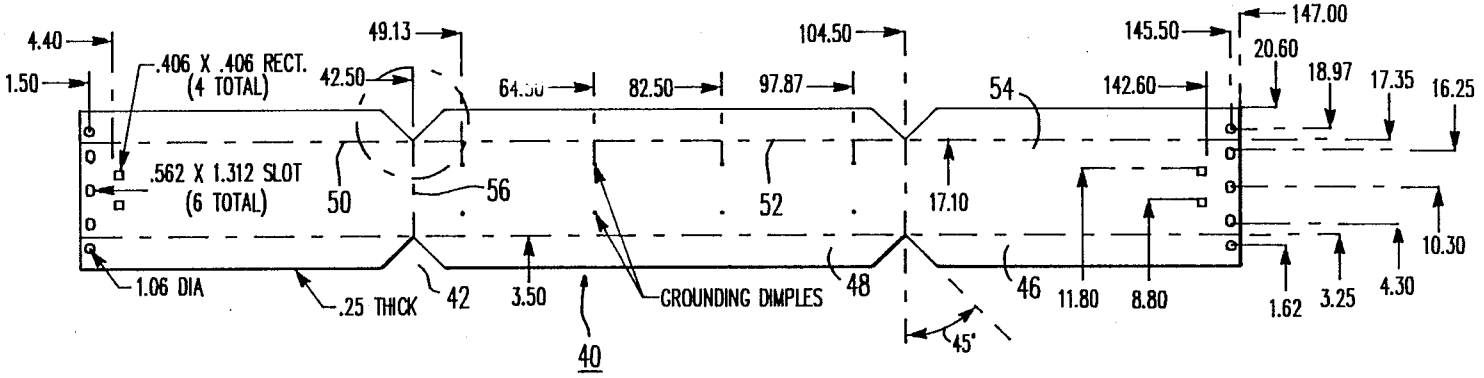
FIG. 6 is a plan view of a stamped blank from which the U-frame which serves as a mounting for the coils and cores is formed.
Figure 7:
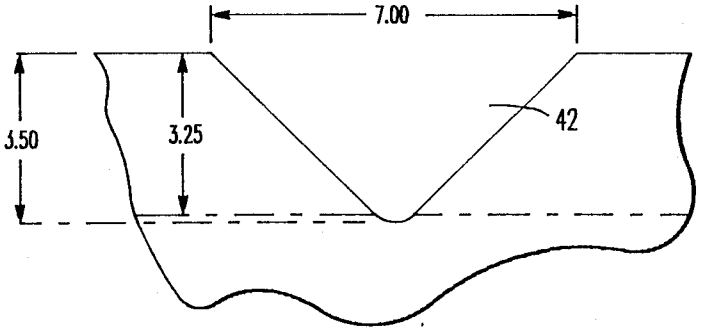
FIG. 7 is a fragmental view, enlarged, showing the V-notch which forms the gap in the corners of the U-frame.
Figure 10:
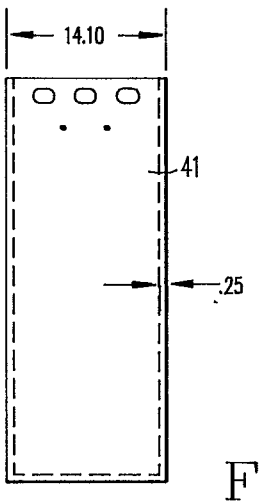
FIG. 10 is a view in side elevation taken in the direction X—X of FIG. 8.
Figure 9:
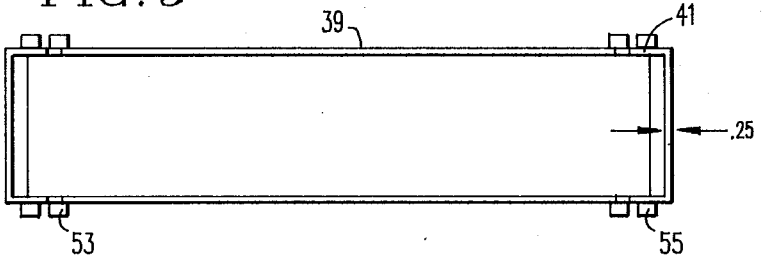
FIG. 9 is a plan view of the U-frame taken in the direction IX—IX of FIG. 8.
Figure 8:
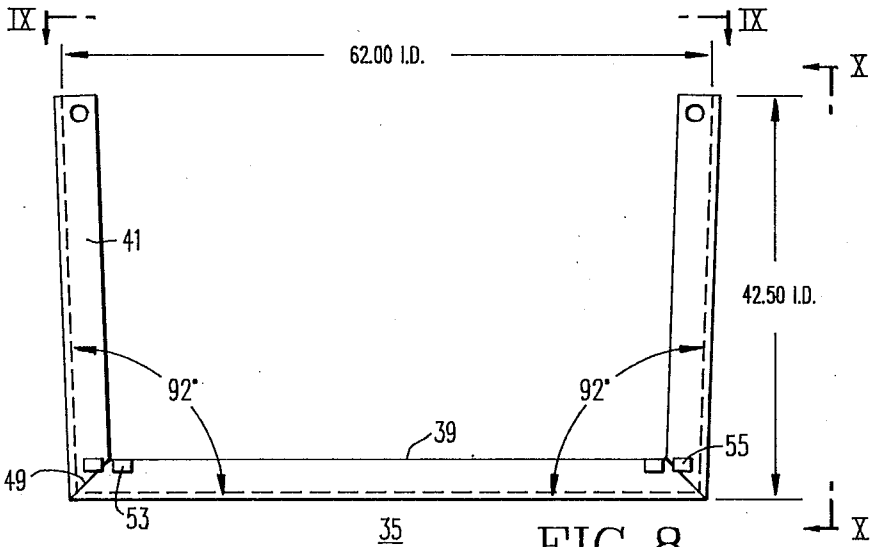
FIG. 8 is a view in front elevation of the U-frame as formed from the blank shown in FIG. 6.

Typically, the U-frame 35 is formed of a long blank 40 as shown in FIG. 6. V-notches 42 are stamped in the blank 40 at intervals corresponding to the dimensions of the cross member 39 and the legs 41. The flanges are formed by bending the strips 46 and 48 at right angles to the blank along the lines 50 and 52. The ends 54 of the blank are bent along lines 56 to form the legs 41 of the U-frame. As shown in FIG. 8, the legs 41 are at an angle of about 92° to the cross member 39. Because each leg 41 is at an angle greater than 90° to the cross member 39, each junction of the flanges 45 of the cross member 39 and the flanges 47 of the legs 41 has an angular gap 49. As shown, the boundaries of each gap are at an angle of 45° to the edge of the cross member 39 and at an equal angle of 45° to the edge of the adjacent leg 41. But the boundaries of the gaps 49 may be at different unequal angles to these edges. Each gap 49 terminates in a solid edge 51 at the corner which is essentially a hinge about which the corresponding leg 41 may be flexed. Near each corner, lugs or bosses 53 and 55 are welded or otherwise secured or joined to the flanges 45 and 47 near the region where they bound each slot 49. For example, the blank 40 may be cast with the lugs at the appropriate positions. Each pair of lugs 53 and 55 spans the associated gap 49. The angle of each leg 41 to the cross member 39 which is shown as 92° may be any other small magnitude, typically between 91° and 93°.

The top frame 37 is a channel having flanges 43 which extend from the ends.

Figure 1:
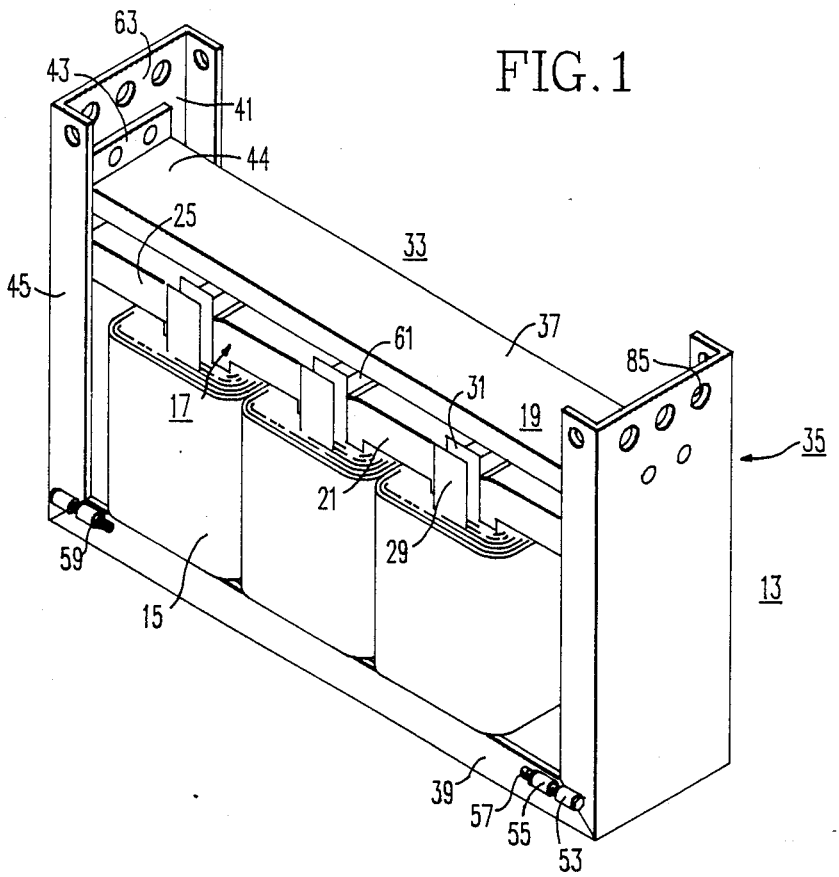
FIG. 1 is a view in isometric of a coil-core assembly in accordance with this invention and which is produced in the practice of the method of this invention.
Figure 5:
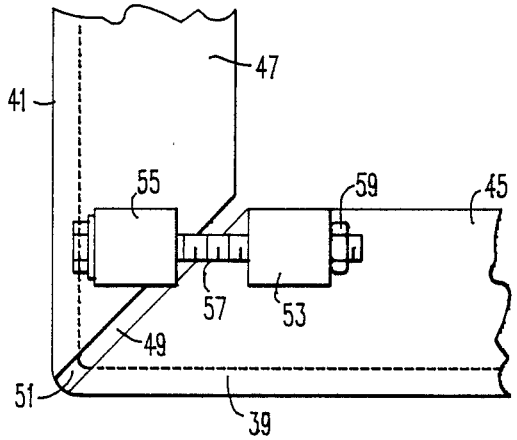
FIG. 5 is a fragmental diagrammatic view showing the portion of this transformer in the enclosure V of FIG. 4.
Figure 2:
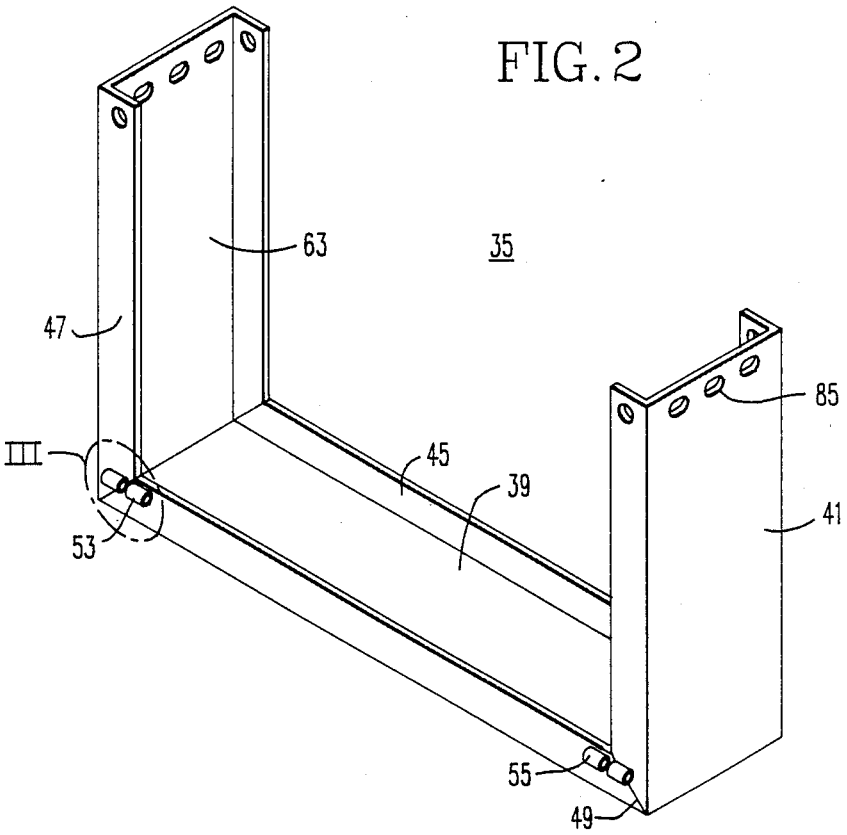
FIG. 2 is a view in isometric showing the U-frame of the coil-core assembly shown in FIG. 1.
Figure 3:
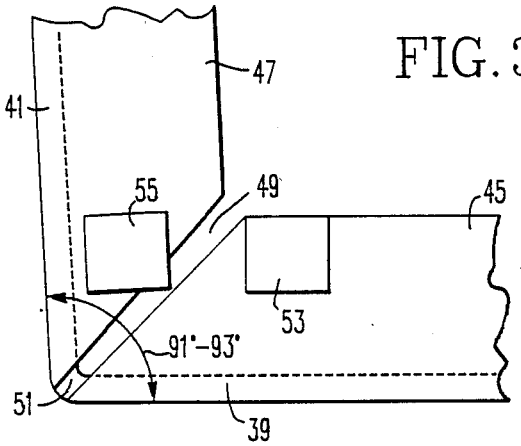
FIG. 3 is a fragmental view, enlarged, in side elevation of a corner of the U-frame shown in FIG. 2 within the closed curve III of FIG. 2.

With the legs 41 deflected outwardly, the coils 15 and cores 17 and 19 are mounted between the legs in the practice of this invention. Each pair of lugs 53 and 55 is then penetrated by a bolt 57. To compensate for misalignment, the inside diameter of the lugs is greater by about 0.030-inch than the diameter of the bolt 57. A nut 59 (FIG. 5) is threaded on the bolt and torqued, flexing each leg 41 to a position substantially at right angles to the cross member 45. To suppress vibrations, the nut 59 is of the swage type. The legs firmly engage the end coils 15. The top frame 37 is then positioned firmly on the connecting bars 61 extending above the cores and secured by its flanges 43 which are bolted to the webs 63 of the legs 41. The coil-core assembly 13 completed is mounted in a tank 71 through which an insulating or dielectric cooling fluid is conducted in the use of the transformer. The line 72 marks the typical level of the fluid. The tank 71 is generally similar to the tank 5 of application Ser. No. 131,704, now U.S. Pat. No. 4,834,257 filed Dec. 11, 1987 to W. J. Book et al., which is incorporated herein by reference. The coil-core assembly 13 is disposed in the tank with its legs 41 opposite the walls 75 and 77 of the tank and its cross member 39, supported on support members 78 on the base 79 of the tank. Braces 81 and 83 are welded to the walls 75 and 77 of the tank. The braces 81 are provided with holes (not shown) which are aligned with holes 85 (FIGS. 1 and 2) near the top of the legs 41 of the U-frame 35. Bolts (not shown) penetrate through the holes 85 and engage the holes not shown in braces 81 to secure the core assembly 13 to the tank. The braces 83 abut the legs 41 of the U-frame below the braces 81. The braces 81 and 83 are mounted on the tank walls 75 and 77 and should not be confused with the braces which were mounted on the legs 41 of the U-frame in prior-art coil-core assemblies. Packing material 87 is interposed between the legs 41 of the U-frame and the sides 75 and 77 of than tank 71. The tank 71 has a top 91 and heat exchange panels 93 through which the cooling dielectric fluid is conducted.

The forces which would be produced by an overload are represented by the arrows 95. These forces would tend to cause the legs 41 of the coil-core assembly to explode outwardly. But these forces are resisted by the lugs 53 and 55, the bolt 57 and the nut 59.

While an embodiment of this invention has been disclosed herein, many modifications thereof are feasible. This invention is not to be restricted, except insofar as is necessitated by the spirit of the prior art.

I claim:

1. A coil-core assembly of a transformer including coil means and core means and mounting means for said coil means and core means, said mounting means including a rigid U-shaped frame encompassing said coil means and core means and having a cross member from whose ends legs extend, the said assembly being characterized by that at the corners of said U-shaped frame said legs are at least in part prespaced from said cross member to facilitate insertion of the frame of the coil means and the core means and also characterized by means connected to each leg and to said cross member near each corner for drawing said legs and said cross member together at each corner when said coil means and core means are encompassed by said mounting means so that said coil means and core means are firmly engaged by said frame and forces generated within said coil means and core means directed outwardly are effectively resisted.

2. The coil-core assembly of claim 1 characterized by that the cross member and legs of the U-shaped frame are channels, each channel including flanges joined by a web and further characterized by that the drawing means at each corner includes a pair of lugs, one lug secured near said each corner to one of said flanges of the leg at said each corner and the other lug secured to the contiguous flange of the cross member near said corner and by a bolt penetrating said lugs and drawing said lugs towards each other.

3. The coil-core assembly of claim 2 characterized by that at each corner of the U-shaped frame there is a gap between the one flange of the leg and the contiguous flange of the cross member and by that the lug on said flange of the leg and the lug on the flange of the cross member are each near said gaps and that the drawing means draws the boundaries of the gap towards each other when the lugs are drawn towards each other by the bolt.

4. The coil-core assembly of claim 3 characterized by that the legs of the frame are at an angle greater by a small magnitude than 90° to the cross member and by that when the lugs are drawn towards each other by the bolt, the legs are pivoted to substantial perpendicularity with the cross member.

5. A coil-core assembly including coil means and core means and mounting means for said coil means and core means, said mounting means including a rigid U-shaped frame encompassing said coil means and core means and having a cross member from whose ends legs extend, the said assembly being characterized by that at least one of the legs of said frame is hinged to the cross member at the corners between the said at-least one leg and said cross member and is deflected outwardly to facilitate insertion of the coil means and core means, and by means, connected to said at-least one leg and to said cross member near said corners, for holding said at-least one leg in firm engagement with said coil means and core means when said coil means and core means are encompassed by said U-shaped frame.

6. The coil-core assembly of claim 5 characterized by that the legs and cross member of the U-shaped frame are channels, each channel having a web joining flanges at its ends, the junctions of the flanges of the at-least one channel and the flanges of the cross member at the corners formed by the at-least one channel and the cross member being separated forming a hinge about which the at-least one channel may pivot and the holding means includes lugs on the flanges of said at-least one leg and on the flanges of said cross member near said junction and a bolt penetrating said lugs and means connected to said bolt operative to reduce the separation between the flanges of the at-least one channel and the flanges of the cross member thereby securing said lugs to set said at-least one channel in firm engagement with the coil means and core means.

7. The coil-core assembly of claim 6 characterized by that the at-least one channel of the U-shaped frame is initially at an angle greater by a small magnitude than 90° to the cross member and is set into perpendicularity with the cross member by the bolt when the lugs are secured in holding relationship.

8. The method of producing a coil-core assembly of a transformer including coil means and core means and a support for said coil means and core means, said coil-core assembly lending itself to ready assembly and being effectively resistant to the forces produced by overloads such as short circuits; the said method including fabricating a U-shaped frame including a cross member from whose ends legs extend, said cross member and legs being channels, each channel having a web from whose ends flanges extend, at least one leg being at an angle greater than 90° by a small magnitude to the cross member whereby there are gaps at the junctions between the flanges of said at-least one leg and the respective contiguous flanges of said cross member, securing a pair of axially coextensive lugs at each junction of said at-least one leg and said cross member to the flanges bounding said gap, each pair of said lugs spanning said gap, penetrating each pair of axially coextensive lugs by a bolt, inserting said coil means and core means into said U-shaped frame, and thereafter threading each said bolt into a cooperative thread to draw each said pair of axially coextensive lugs towards each other, thereby drawing said at-least one leg into substantial perpendicularity with said cross member and securing said coil means and core means firmly in said U-frame.

9. The method of producing a coil-core assembly of a transformer including coil means and core means and a support for said coil means and core means, said coil-core assembly lending itself to ready assembly and being effectively resistant to the forces produced by overloads such as short circuits; the said method including fabricating a U-shaped frame including a cross member from whose ends legs extend, said cross member and legs being channels, each channel having a web from whose ends flanges extend, each said leg being at an angle greater than 90° by a small magnitude to the cross member whereby there are gaps at the junctions between the flanges of each said leg and the respective contiguous flanges of said cross member, securing a pair of axially coextensive lugs at each junction of each said leg and said cross member to the flanges bounding said gap, each pair of said lugs spanning said gap, penetrating each pair of axially coextensive lugs by a bolt, inserting said coil means and core means into said U-shaped frame, and threading each said bolt into a cooperative thread to draw each said pair of axially coextensive lugs towards each other, thereby drawing each said leg into substantial perpendicularity with said cross member and securing said coil means and core means firmly in said U-frame.

10. The method of claim 8 characterized by that each pair of axially coextensive lugs have coextensive holes, each hole having a diameter slightly greater than the diameter of the bolt and by that the cooperative thread is the thread of a nut threaded onto the bolt.

11. The method of claim 8 characterized by that each pair of axially coextensive lugs is secured to outer surfaces of the at-least one leg and cross member of the U-shaped frame.

12. The coil-core assembly of claim 6 wherein the separation-reducing means is a swaged nut threaded onto the bolt.

* * * * *